US006573875B2

(12) United States Patent
Zimmerman et al.

(10) Patent No.: US 6,573,875 B2
(45) Date of Patent: Jun. 3, 2003

(54) ANTENNA SYSTEM

(75) Inventors: Martin L. Zimmerman, Chicago, IL (US); Jamie Paske, Darien, IL (US); Jim Giacobazzi, Bloomingdale, IL (US); Kevin E. Linehan, Justice, IL (US)

(73) Assignee: Andrew Corporation, Orland Park, IL (US)

( * ) Notice: Subject to any disclaimer, the term of this patent is extended or adjusted under 35 U.S.C. 154(b) by 115 days.

(21) Appl. No.: 09/788,790

(22) Filed: Feb. 19, 2001

(65) Prior Publication Data

US 2002/0126059 A1 Sep. 12, 2002

(51) Int. Cl.[7] ..... H01Q 21/00; H01Q 3/00

(52) U.S. Cl. ..... 343/853; 343/757

(58) Field of Search ..... 343/853, 757, 343/700 MS; 342/371, 372, 374; 333/161

(56) References Cited

U.S. PATENT DOCUMENTS

| | | | | |
|---|---|---|---|---|
| 2,041,600 | A | 5/1936 | Friis | 342/361 |
| 2,432,134 | A | 12/1947 | Bagnall | 342/374 |
| 2,540,696 | A | 2/1951 | Smith, Jr. | 343/766 |
| 2,596,966 | A | 5/1952 | Lindsay, Jr. | 343/816 |
| 2,648,000 | A | 8/1953 | White | 343/791 |
| 2,773,254 | A | 12/1956 | Engelmann | 342/365 |
| 2,836,814 | A | 5/1958 | Nail | 342/368 |
| 2,968,808 | A | 1/1961 | Russell | 342/375 |
| 3,032,759 | A | 5/1962 | Ashby | 342/154 |
| 3,032,763 | A | 5/1962 | Sletten | 343/824 |
| 3,277,481 | A | 10/1966 | Robin et al. | 342/373 |
| 3,969,729 | A | 7/1976 | Nemit | 343/756 |
| 4,129,872 | A | 12/1978 | Toman | 343/768 |
| 4,176,354 | A | 11/1979 | Hsiao et al. | 343/17.7 |
| 4,241,352 | A | 12/1980 | Alspaugh et al. | 343/700 MS |
| 4,249,181 | A | 2/1981 | Lee | 343/100 CS |

(List continued on next page.)

FOREIGN PATENT DOCUMENTS

| | | | |
|---|---|---|---|
| AU | B-38746/93 | 7/1993 | H01Q/21/12 |
| AU | B-41625/93 | 1/1994 | H01Q/3/36 |
| AU | B-80057/94 | 5/1995 | H01Q/3/32 |
| DE | 3322-986 A | 6/1983 | |
| DE | 3323-234 A | 6/1983 | H01Q/3/38 |
| DE | 3323 234 A1 | 1/1985 | H01Q/3/38 |
| EP | 0 540 387 A2 | 5/1983 | H04B/7/26 |

(List continued on next page.)

OTHER PUBLICATIONS

Product Sheet for "900 MHz Base Station Antennas For Mobile Communication," Kathrein, 2 pages (no date).

PCT International Search Report for International Application No. PCT/US02/01993.

Variable–Elevation Beam–Aerial Systems for 1 ½ Metres, *Journal IEE Part IIIA,* vol. 93, 1946, Bacon, G.E.

Radar Antennas, *Bell Systems Technical Journal,* vol. 26, Apr., 1947, pp. 219 to 317, Friis, H.T. and Lewis, W.D.

*The Sydney University Cross–Type Radio Telescope,* Proceedings of the IRE Australia, Feb., 1963, pp. 156 to 165, Mills, B.Y., et al.

(List continued on next page.)

*Primary Examiner*—Hoang Nguyen
(74) *Attorney, Agent, or Firm*—Welsh & Katz, Ltd.

(57) ABSTRACT

An antenna assembly for emitting a signal. The antenna assembly includes at least two antennas which are separated into a first group and a second group. Both groups of antennas are mounted on a panel. A first phase adjuster is coupled to the first antenna group. The first phase adjuster is also coupled to a second phase adjuster, which is also coupled to said second antenna group. The first phase adjuster is coupled to the second phase adjuster, such that an adjustment of the first phase adjuster causes an adjustment of the second phase adjuster. The first phase adjuster is adapted to adjust a phase angle of the signal of the first antenna group, while the second phase adjuster is adapted to adjust a phase angle of the signal of said second antenna group.

55 Claims, 8 Drawing Sheets

U.S. PATENT DOCUMENTS

| | | | | | |
|---|---|---|---|---|---|
| 4,427,984 | A | | 1/1984 | Anderson | 343/764 |
| 4,451,699 | A | | 5/1984 | Gruenberg | 455/17 |
| 4,532,518 | A | | 7/1985 | Gaglione et al. | 343/372 |
| 4,564,824 | A | | 1/1986 | Boyd, Jr. | 333/137 |
| 4,575,697 | A | | 3/1986 | Rao et al. | 333/157 |
| 4,652,887 | A | | 3/1987 | Cresswell | 343/766 |
| 4,714,930 | A | | 12/1987 | Winter et al. | 343/786 |
| 4,717,918 | A | | 1/1988 | Finken | 342/368 |
| 4,768,001 | A | | 8/1988 | Chan-Son-Lint et al. | 333/159 |
| 4,779,097 | A | | 10/1988 | Morchin | 342/368 |
| 4,788,515 | A | | 11/1988 | Wong et al. | 333/160 |
| 4,791,428 | A | | 12/1988 | Anderson | 343/758 |
| 4,804,899 | A | | 2/1989 | Wurdack et al. | 318/600 |
| 4,814,774 | A | | 3/1989 | Herczfeld | 342/372 |
| 4,821,596 | A | | 4/1989 | Eklund | 74/479 |
| 4,881,082 | A | | 11/1989 | Graziano | 342/432 |
| 5,162,803 | A | | 11/1992 | Chen | 342/372 |
| 5,175,556 | A | | 12/1992 | Berkowitz | 342/354 |
| 5,181,042 | A | | 1/1993 | Kaise et al. | 343/700 MS |
| 5,184,140 | A | | 2/1993 | Hariu et al. | 342/372 |
| 5,214,364 | A | | 5/1993 | Perdue et al. | 318/600 |
| 5,281,974 | A | | 1/1994 | Kuramoto et al. | 343/700 MS |
| 5,440,318 | A | | 8/1995 | Butland et al. | 343/814 |
| 5,488,737 | A | | 1/1996 | Harbin et al. | 455/33.1 |
| 5,512,914 | A | | 4/1996 | Hadzoglou et al. | 343/816 |
| 5,551,060 | A | | 8/1996 | Fujii et al. | 455/33.4 |
| 5,596,329 | A | | 1/1997 | Searle et al. | 342/374 |
| 5,617,103 | A | * | 4/1997 | Koscica et al. | 343/700 MS |
| 5,659,886 | A | | 8/1997 | Taira et al. | 455/81 |
| 5,798,675 | A | | 8/1998 | Drach | 333/161 |
| 5,801,600 | A | | 9/1998 | Butland et al. | 333/127 |
| 5,805,996 | A | | 9/1998 | Salmela | 455/453 |
| 5,818,385 | A | | 10/1998 | Bartholomew | 342/372 |
| 5,832,365 | A | | 11/1998 | Chen et al. | 455/15 |
| 5,905,462 | A | | 5/1999 | Hampel et al. | 342/372 |
| 5,917,455 | A | * | 6/1999 | Huynh et al. | 343/792.5 |
| 5,995,062 | A | | 11/1999 | Denney et al. | 343/853 |
| 6,188,373 | B1 | | 2/2001 | Markek | 343/893 |
| 6,198,458 | B1 | * | 3/2001 | Heinz et al. | 343/853 |
| 6,239,744 | B1 | | 5/2001 | Singer et al. | 342/359 |

FOREIGN PATENT DOCUMENTS

| | | | | |
|---|---|---|---|---|
| EP | 137-562 | A | 10/1983 | H01Q/3/36 |
| EP | 0 137 562 | A2 | 4/1985 | H01Q/3/36 |
| EP | 241-153 | A | 4/1986 | H01Q/3/38 |
| EP | 0 241 153 | B1 | 10/1987 | H01Q/3/38 |
| EP | 357-165 | A | 8/1988 | H01Q/3/36 |
| EP | 398-637 | A | 5/1989 | H01Q/3/38 |
| EP | 0 357 165 | A2 | 3/1990 | H01Q/3/36 |
| EP | 0 398 637 | A2 | 11/1990 | H01Q/3/38 |
| EP | 0 423 512 | A2 | 4/1991 | H01Q/3/38 |
| EP | 0 588 179 | A1 | 3/1994 | H01Q/3/42 |
| EP | 0 593 822 | A1 | 4/1994 | H01Q/25/00 |
| EP | 0 595 726 | A1 | 5/1994 | H01Q/3/46 |
| EP | 0 618 639 | A2 | 10/1994 | H01Q/3/26 |
| EP | 0 616 741 | B1 | 11/1995 | H04B/7/26 |
| FR | 2 581 255 | | 10/1986 | H01P/1/18 |
| GB | 1 314 693 | | 4/1973 | H01P/1/18 |
| GB | 2 035 700 | A | 6/1980 | H01Q/3/36 |
| GB | 2 158 996 | A | 11/1985 | H01Q/3/36 |
| GB | 2 159 333 | A | 11/1985 | H01Q/3/36 |
| GB | 2 165 397 | A | 4/1986 | H01Q/3/36 |
| GB | 2 196 484 | A | 4/1988 | H01Q/3/36 |
| GB | 2 205 946 | A | 12/1988 | H01Q/3/38 |
| GB | 2 232 536 | A | 12/1990 | H01Q/3/36 |
| JP | 61-172411 | | 8/1986 | H01Q/21/22 |
| JP | 1-120906 | | 5/1989 | H01Q/3/26 |
| JP | 02-174302 | A | 4/1990 | H01Q/3/26 |
| JP | 02-174403 | A | 4/1990 | H01Q/3/32 |
| JP | 2-121504 | | 5/1990 | H01Q/3/04 |
| JP | 2-174402 | | 7/1990 | H01Q/3/16 |
| JP | 2-290306 | | 11/1990 | H01Q/3/32 |
| JP | 4-286407 | | 10/1992 | H01Q/21/06 |
| JP | 5-121915 | | 5/1993 | H01P/5/12 |
| JP | 5-191129 | | 7/1993 | H01Q/3/34 |
| JP | 6-196927 | | 7/1994 | H01Q/25/00 |
| JP | 08047043 | A | 2/1996 | H01Q/3/26 |
| NZ | 264864 | | 11/1994 | |
| NZ | 272778 | | 8/1995 | |
| WO | WO 88/08621 | | 11/1988 | H01Q/3/36 |
| WO | WO 92/16061 | | 9/1992 | H04B/7/26 |
| WO | WO 93/12587 | | 6/1993 | H04B/7/26 |
| WO | WO 95/10862 | | 4/1995 | H01Q/3/32 |
| WO | WO 96/14670 | | 5/1996 | |

OTHER PUBLICATIONS

"Microwave Scanning Systems" published about 1985, pp. 48 to 131.

"Low Sidelobe and Titled Beam Base–Station Antennas for Smaller–Cell Systems," published in or about 1989, Yamada & Kijima, NTT Radio Communication Systems Laboratories, pp. 138 to 141.

"Electrical Downtilt Through Beam–Steering versus Mechanical Downtilt," G. Wilson, published May 18, 1992, pp. 1–4.

*Mobile Telephone Panel Array (MTPA) Antenna: Field Adjustable Downtilt Models* published in Australia on or about May 4, 1994.

*Mobile Telephone Panel Array (MTPA) Antenna: VARITILT Continuously Variable Electrical Downtilt Models* (including specifications sheet) published in Australia on or about Sep. 1994.

Supplementary European Search Report for Application No. EP 95 93 3674 dated Jan. 9, 1999.

International Search Report for PCT/NZ 95/00106 mailed Jan. 23, 1996.

Microstrip Base Station Antennas for Cellular Communications, Strickland et al., 1991 IEEE.

Antennas, NIG Technical Reports vol. 57, Mar. 8–11, 1977 (including original in German and complete translation into English).

Beam Steering of Planar Phased Arrays –T.C. Cheston, John Hopkins University, Applied Physics Laboratory (Chapter in Phased Array Antennas, Oliner & Knittel 1972).

European Search Report for Application No. EP 02 01 0597.

* cited by examiner

ANTENNA SYSTEM

BACKGROUND OF THE INVENTION

In many passive antenna assemblies, it is often desired to be able to adjust a radiation pattern of the antenna assembly after the antenna assembly has been installed on a tower. The need may arise due to a number of factors, including new construction, which may create obstacles, vegetation growth, or other changes in the surrounding environment. It may also be desired to alter the radiation pattern due to performance studies or to alter the shape of the area the antenna covers.

There are various ways that the radiation pattern may be altered. One method is to physically change the location of the antenna assembly. Once the assembly has been installed on a tower, however, this becomes difficult. It is also possible to change the azimuth and elevation of the individual antennas, but such a method is expensive when applied to several antennas. Also, the mechanical device required to adjust the azimuth and elevation may interfere with the mechanical antenna mount.

Another method that has been utilized to adjust the radiation pattern of a number of antennas grouped onto one antenna assembly is to alter the phase angle of the individual antennas. By altering the phase angle of the individual antennas, a main beam (which causes the radiation pattern) is tilted relative to the surface of the earth. The antennas are grouped into a first group, a second group, and a third group. All three groups are disposed along a panel of the antenna assembly. A phase adjuster is disposed between two of the antenna groups, such that an adjustment of the phase adjuster changes the radiation pattern. The phase adjuster comprises a conductor coupled with a transmission line to create a capacitor. The conductor is rotatable and moves along the transmission line, changing the location of the capacitor on the transmission line. The transmission line is coupled to an antenna which has a phase angle. The phase angle is dependant partially on the location of the capacitor. Thus, by changing the location of the capacitor, the phase angle is changed. The phase adjuster may be coupled to a plurality of antennas and acts to adjust the phase angle of all of them.

The phase adjusters currently in use, however, have numerous drawbacks. First, the conductor is often made of brass which is expensive to etch and cut. Therefore, the conductor is usually cut in a rectangular shape. The path of the transmission line, however, is arcuate. The conductor does not cover the entire width at the capacitor, which decreases the effectiveness of the capacitance.

Another problem with current phase adjusters is the coupling of a power divider to the phase adjuster. The antenna assembly receives power from one source. Each of the three groups of antennas, however, has different power requirements. Thus, power dividers must be connected to the assembly. Currently, a power divider may be a series of cables having different impedances. Using a variety of cables makes manufacturing difficult since the cables have to be soldered together. Also, since manual work is required, the chances of an error occurring is increased. Another method of dividing the power is to create a power divider on a PC board and then cable the power divider to the phase adjuster. Although this decreases some costs, it still requires the extensive use of cabling, which is a disadvantage.

A third problem is caused by the use of cable lines having different lengths to connect an antenna to the appropriate output from the phase adjuster. Each antenna has a different default phase angle when the phase adjuster is set to zero. The default phase angle is a function of the cable length coupled with the length of the transmission line. To achieve the differing default phase angles, cables of varying lengths are attached to different antennas. Although this only creates a slight increase in manufacturing costs since cables of varying lengths must be purchased, it greatly increases the likelihood of error during installation. In numerous antenna assemblies, the cable lengths only differ by an inch or less. During assembly, if a cable is not properly marked, it may be difficult for the person doing the assembly to tell the difference between the different sizes of cable.

To move the phase adjuster, an actuator is located on a side of the panel and may include a small knob or rotatable disc for manually changing the phase adjuster. Thus, whenever the radiation pattern needs to be adjusted, a person must climb the tower and up the side of the panel to the phase adjuster. This is a difficult and time consuming process. Also, it is only possible to move the actuator manually, requiring the exertion of physical labor. In addition, it is a dangerous activity since the antennas are located on a tower and it is possible for a person to fall or otherwise become injured in the climbing process.

BRIEF DESCRIPTION OF THE DRAWINGS

The foregoing and other advantages of the invention will become apparent upon reading the following detailed description and upon reference to the drawings.

Figure 1:
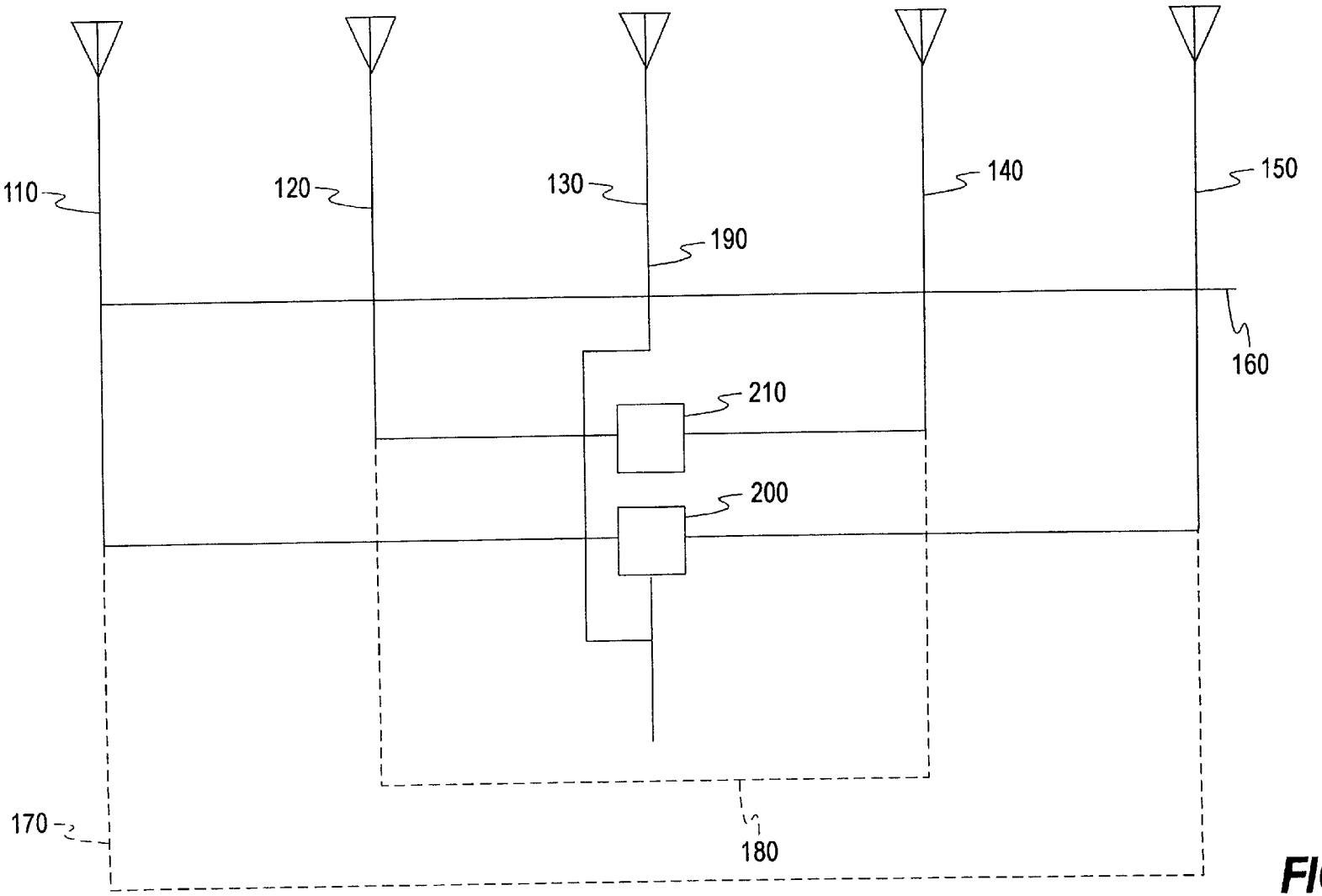
FIG. 1 is a schematic of an antenna assembly of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

FIG. 1 is a side view of an antenna assembly 100 of the present invention. The antenna assembly 100 is comprised of a plurality of antennas 110, 120, 130, 140, 150 disposed along a panel 160. The antennas 110, 120, 130, 140, 150 are grouped into a first group 170, a second group 180, and a third group 190. The first antenna 110 and the fifth antenna 150 are in the first group 170. The second antenna 120 and the fourth antenna 140 are in the second group 180 and the third antenna 130 is in the third group 190.

To adjust the radiation pattern, the vertical electromagnetic beam of the antenna assembly 100 must be adjusted. This is accomplished by adjusting the phase angle of the first group 170 relative to the second group 180. The first group 170, however, must be adjusted by an amount different than the amount of the second group 180. To accomplish this, a first phase adjuster 200 is attached to the first group 170, and a second phase adjuster 210 is attached to the second group 180. The adjustment amount of the second group 180 is often a function of the amount of adjustment of the first group 170. To ensure that the first and second groups 170, 180 are adjusted in the correct ratio, the second adjuster 210 may be connected to the first adjuster 200, such that an adjustment of the first adjuster causes an adjustment of the second adjuster. More particularly, the second phase adjuster 210 may be connected to the first phase adjuster 200, such that an adjustment of the first phase adjuster 200 for a predetermined distance causes the second phase adjuster 210 to move proportional to the distance.

Figure 2:
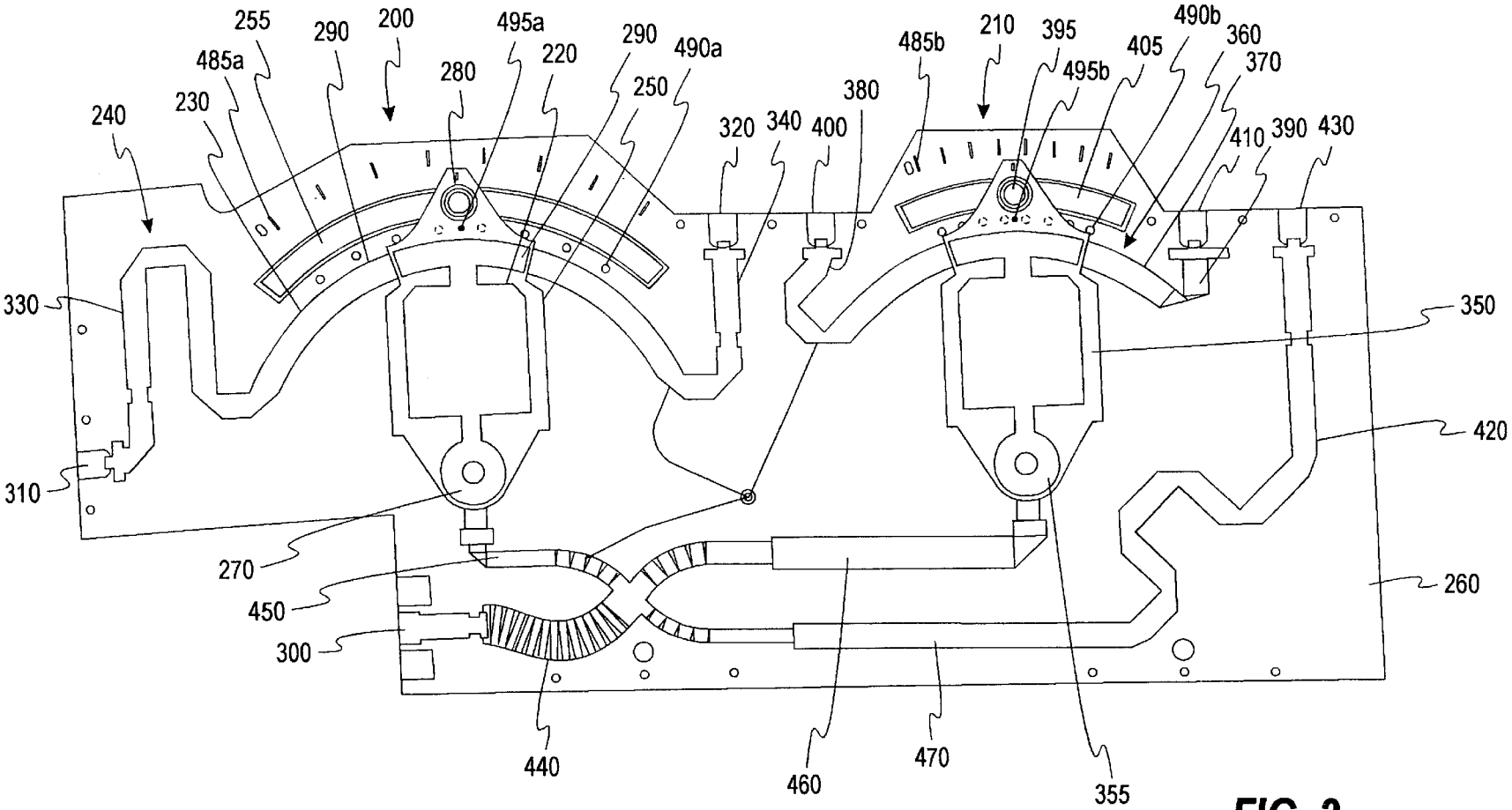
FIG. 2 is a schematic view of a phase adjuster assembly according to one embodiment of the present invention.

FIG. 2 depicts a schematic view of a first and second phase adjusters 200, 210 respectively, adapted to adjust the vertical beam or vertical beam downtilt angle. The first phase adjuster 200 is coupled to the first antenna group 170, and the second phase adjuster 210 is coupled to the second antenna group 180. Each of the plurality of antennas 110, 120, 130, 140, 150 has a different phase angle. By adjusting the phase angles of the plurality of antennas 110, 120, 130, 140, 150, or at least of the first and second groups 170, 180 of antennas, the vertical beam of the antenna assembly 100 is adjusted.

The first and second phase adjusters 200, 210 operate in the same fashion. For simplicity, the description will be described in more detail regarding the first phase adjuster 200. To adjust the phase angle, a conductive wiper 220 slides over a first arcuate portion 230 of a first transmission line 240. One end of the first transmission line 240 is coupled to the first antenna 110, while the other end of the first transmission line 240 is coupled to the fifth antenna 150. The conductive wiper 220 in connection with the first arcuate portion 230 acts as a capacitor. To the antennas 110, 150, the capacitor is seen as a short circuit at high frequencies. The length of the first transmission line 240 up to the point of the short circuit affects the phase angle of the antenna. As the conductive wiper 220 slides over the first arcuate portion 230, the location of the short circuit changes, changing the length of the first transmission line 240 and, thus, the phase angle of the two antennas 110, 150. Since the antennas 110, 150 are located at opposite ends of the first transmission line 240, the movement of the short circuit lengthens one transmission line as seen by one antenna while shortening the transmission line as seen by the other antenna. In other words, the transmission line has a finite length. The finite length of the transmission line is divided into a first effective length and a second effective length. The first effective length is from the first antenna 110 to the location of the wiper 220 on the transmission line 240. The second effective length is measured from the fifth antenna 150 to the location of the wiper 220 on the transmission line 240. As the wiper 220 is adjusted towards the fifth antenna 150, the first effective length is lengthened while the second effective length is shortened. As the wiper 220 is adjusted towards the first antenna 110, the first effective length is shortened while the second effective length is lengthened.

In this particular embodiment, the conductive wiper 220 is a first rotatable PC board 250 with a metallic side. The first transmission line 240 is mounted on a separate fixed PC board 260. The fixed PC board 260 and first rotatable PC board 250 act as a dielectric between the capacitor. In prior art systems, an air dielectric was sometimes used. If the conductive wiper changes its spacing relative to the first arcuate portion 230, however, the capacitor's capacitance is altered, thus, changing the impedance match of the phase shifter. If the two sections touch, the capacitance is destroyed, which adversely affects the performance of the antenna even more. Other systems use a sheet dielectric to separate the conductive wiper from the transmission line which have to be mounted using standoffs and point fasteners. The sheet, however, tends to attenuate the capacitive effect. By using the PC boards as the dielectric, the conductive wiper cannot touch the transmission line nor are the capacitive effects attenuated. Also, the manufacturing costs for making the PC board are much lower than having to mount the sheet dielectric.

The first rotatable PC board 250 is pivotally connected to the fixed PC board 260 at a joint 270, which acts as the pivot point for the first rotatable PC board 250. At another end, a joint 280, the first rotatable PC board 250 is slidably mounted in a first slot 255. A mechanical actuator (to be described) including an actuator rod 500 and a main arm 500*a* moves the first rotatable PC board 250 in an arcuate path over the first arcuate portion 230, thus changing the phase angle of the antennas 110, 150 as discussed above.

To increase the capacitive effects, an end 290 of the first rotatable PC board 250 that glides over the first arcuate portion 230 may be curved. The radius of curvature of the end 290 of the first rotatable PC board 250 is the same as the radius of curvature of the first arcuate portion 230. Also, both the first rotatable PC board 250 and the first arcuate portion 230 have the same center point located at the joint 270. By completely aligning with the arcuate portion 230, the capacitance is increased, increasing the effectiveness of the first phase adjuster 200.

The first transmission line 240 is electrically connected to an input 300 for receiving power. The first rotatable PC board 250 is also electrically connected to the input 300. The first transmission line 240 is coupled to the first antenna 110 (shown in FIG. 1) at a first output 310, and also to the fifth antenna 150 (shown in FIG. 1) at a fifth output 320. Each of the antennas 110, 150 has a default phase angle when the capacitor is set to zero, which is marked on FIG. 2. The default phase angle of antenna 110 is a function of the length of the first transmission line 240 and a cable line (not shown) connecting the first transmission line 240 to the antenna 110. The first transmission line 240 includes a first path 330 leading from the first arcuate portion 230 to the first output 310. The length of the first path 330 is determined by the default phase angle of the first antenna 110. The first transmission line 240 also has a second path 340 connecting the first arcuate portion 230 to the fifth output 320. The length of the second path 340 is determined by the default angle of the fifth antenna 150. By varying the length of the first path 330 and the fifth path 340, the same length cables can be used during installation to connect the antennas to the output, which makes installation easier.

The second phase adjuster 210 acts in the same way as the first phase adjuster 200. A second rotatable PC board 350 is mounted on the fixed PC board 260 and is electrically coupled to the input 300. The second rotatable PC board 350 is rotatable around a joint 355, which is also where the second rotatable PC board 350 is connected to the fixed PC board 260. A second transmission line 360 having a second arcuate portion 370, a first path 380, and a second path 390 is also electrically connected to the input 300. The second rotatable PC board 350 glides over the second arcuate portion 370 to create the capacitor. The second rotatable PC board 350 is moved by mechanical actuator comprising actuator rod 500 and main arm 500*a*. Main arm 500*a* is connected through a linkage to be described to the board 350 at a joint 395 located in a second slot 405 in the fixed PC board 260. The first path 380 of the second transmission line 360 is connected to a second output 400, which is coupled to the second antenna 120 (FIG. 1), while the second path 390 of the second transmission line 360 is connected to a fourth output 410, which is coupled to the fourth antenna 140. As with the first phase adjuster 200, the lengths of the first and second paths 380, 390 are adjusted to create the proper default phase angle.

Also connected to the input 300 is a third transmission line 420, which is coupled to a third output 430, which is connected to the third antenna 130. The third transmission line 420 is of a length to create the proper default phase angle. Since all of the individual paths 330, 340, 380, 390, 420 of the various transmission lines 240, 360, 420 are adjusted to create the proper default phase angle, the same length cable can be used to connect the antennas 110, 120, 130, 140, 150 to their respective outputs 310, 400, 430, 410, 320. This not only makes manufacturing easier, it also eliminates the possibility of error during installation of connecting the wrong length cable to the output.

The input 300 is connected to a conductive strip 440 which acts as a power divider and bleeds off power to the first and second phase adjusters 200, 210 and the third transmission line 420. The conductive strip 440 has an established impedance. The impedance of the strip 440 is a function of the width of the strip 440. By changing the width of the conductive strip 440, the impedance and, thus, the power is changed. In the present invention, the conductive strip 440 branches into a first strip 450, a second strip 460, and a third strip 470. The first strip 450 transfers power from the conductive strip 440 to the first phase adjuster 200. The second strip 460 transfers power from the conductive strip 440 to the second phase adjuster 210, and the third strip 470 transfers power from the conductive strip 440 to the third transmission line 420. The width of each of the first, second, and third strips 450, 460, 470 is manufactured to draw the correct amount of power from the conductive strip (or power divider) 440. By using a power divider on the fixed PC board 260, excess cables are eliminated, which decreases cost and also increases the reliability of the antenna assembly 100. In another embodiment of the present invention, a conductive strip can be included to divide power on the first and second transmission lines 240, 360 along the arcuate portions 230, 370.

It is sometimes desirable to lock the first and second phase adjusters in a permanent position. In current systems, a phase adjuster was locked into position at the time of manufacture since the phase adjuster does not include markings or the like. In one embodiment of the present invention, however, the fixed PC board 260 includes a first set of markers 480*a* over the first slot 255 and a second set of markers 480*b* over the second slot 405. The sets of markers 485*a*, 485*b* provide a user with a method for viewing the phase angle settings of the first and second phase adjusters 200, 210. A locking mechanism 485 is included to lock the first and second phase adjusters 250, 350 in a set position. In one embodiment, a series of through holes 490*a*, 490*b* may also be included on the fixed PC board 260 and align with through holes 495*a*, 495*b* on the first and second rotatable PC boards 250, 350. A screw (not shown) may be used to lock the first or second first rotatable PC board 250, 350 to the fixed PC board 260. The use of markings and a lock system is a great improvement because the fixed PC board 260 can be assembled to the first and second phase adjusters 200, 210 without knowing if the phase angles need to be locked. Thus, this device may be manufactured prior to a purchase order being received. Once a purchase order is made, the markings and lock system can be used to lock the first and second phase adjusters 200, 210 in place, if so desired.

Figure 3:
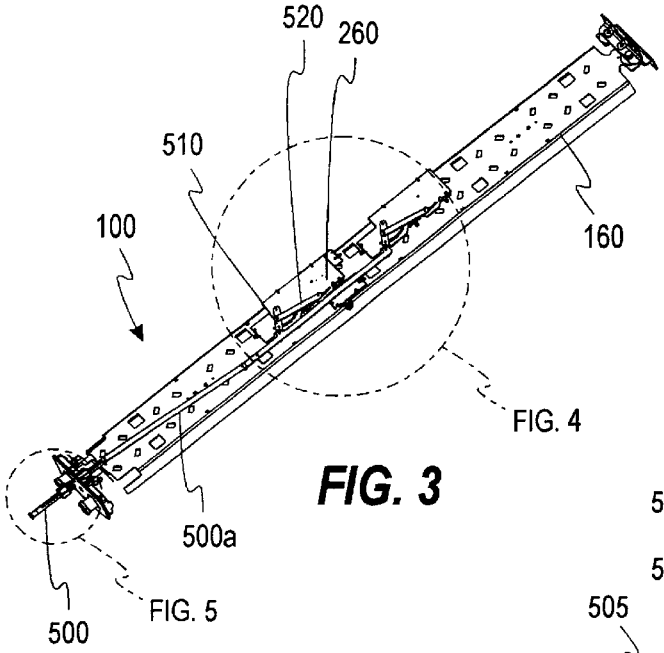
FIG. 3 is perspective side view of a panel and the phase adjuster assembly according to one embodiment of the present invention.
Figure 4:
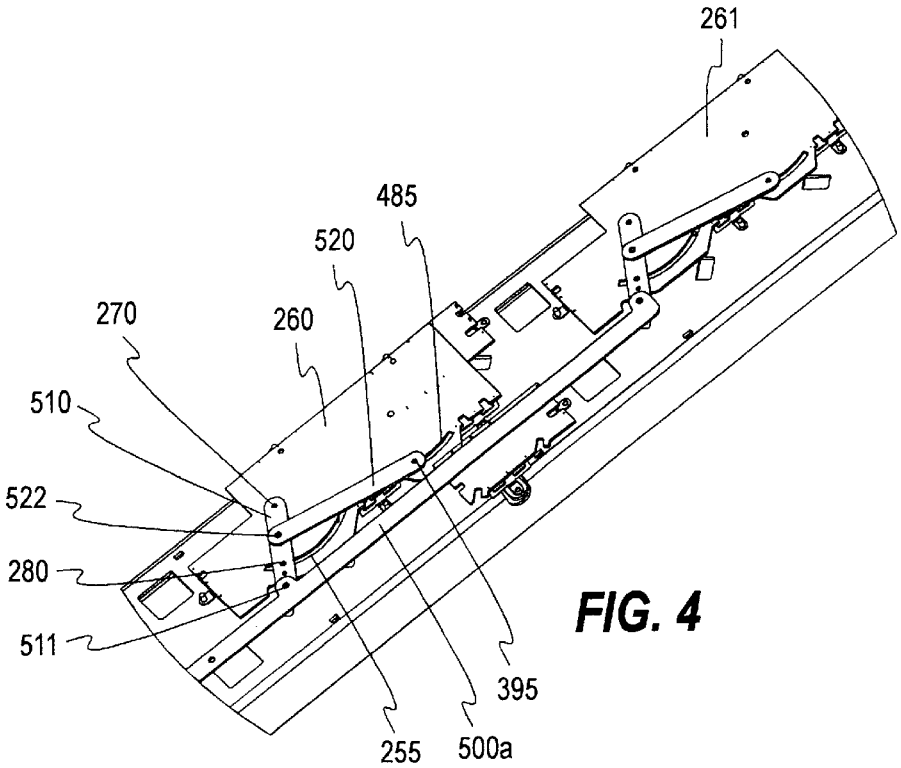
FIG. 4 is an enlarged view of section B shown in FIG. 3.

Turning now to FIGS. 2–4, FIG. 2 depicts a front side of the fixed PC board 260. FIG. 3 depicts a perspective view of a side of the panel 160 of the antenna assembly 100 and a back side of the fixed PC board 260. FIG. 4 is an enlarged detail of FIG. 3. In FIGS. 3 and 4, two similar PC boards 260, 261 are shown, each having a pair of first and second phase adjusters 200, 210. Both pairs operate in the same fashion, and are only illustrated to demonstrate that a plurality of PC boards 260, 261 may be mounted on a single panel, both being coupled to the same mechanical actuator (rod 500 and main arm 500*a*). As discussed above, the first phase adjuster 200 comprises the fixed PC board 260 with the first arcuate slot 255 cut through and the first rotatable PC board or wiper 250 (FIG. 2) on the other side of the fixed PC board 260. The second phase adjuster 210 comprises the fixed PC board 260, the second rotatable PC board or wiper 350 (FIG. 2), and the second arcuate slot 485. To cause the first and second rotatable PC boards 250, 350 to rotate, the main arm 500*a* is coupled to the rotatable PC boards 250, 350.

In one embodiment, the mechanical actuator comprises an actuator rod 500, main arm 500*a* and a linkage comprising a first arm 510, and a second arm 520. The main arm 500*a* is connected to one end of the first arm 510 at a pivot point 511. The other end of the first arm 510 is connected to the fixed PC board 260 and the first rotatable PC board 250 at the joint 270. A cross-section of this joint 270 would show there are three layers all connected, the first rotatable PC board 250, the fixed PC board 260, and the first arm 510. Since the fixed PC board 260 is stationary, the first arm 510 and the first rotatable PC board 250 also remain fixed at the joint 270. The joint 280 connects the first rotatable PC board 250 to the first arm 510 through the first slot 255 on the fixed PC board 260.

The second arm 520 is connected to the second rotatable PC board 350 through the second slot 405 at the joint 395. Thus, a movement of the second arm 520 causes the second rotatable PC board 350 to move along the second slot 405. The second arm 520 is also rotatably connected at a joint 522 to approximately midway between joint 270 and joint 280 on the first arm 510. Thus, as the first arm 510 is moved, the second arm 520 also moves. Since the second arm 520 is linked to the first arm 510 at the midpoint, as the joint 512 of the first arm 510 moves a predetermined distance, the joint 395 of the second arm 520 moves approximately half the predetermined distance. In other embodiments, the second arm 520 may be attached at different locations over the first arm 510, depending upon the desired ratio of movement between the first and second phase adjusters 200, 210.

Figure 5:
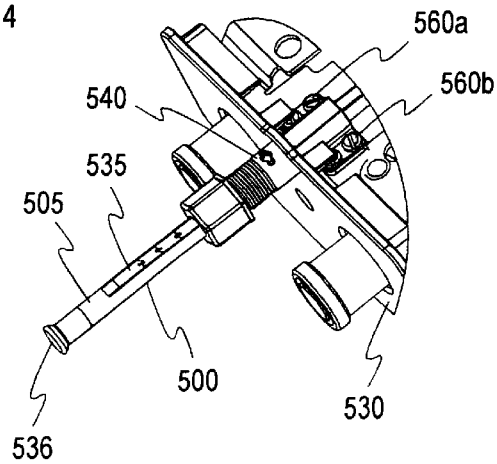
FIG. 5 is an enlarged view of section A shown in FIG. 3.

FIG. 5 illustrates a grasping end 505 of the actuator rod 500 that extends out past a bottom 530 of the panel 160. The grasping end 505 of the actuator rod 500 is mounted on the bottom 530 of the panel 160. By extending the actuator rod 500 out through the bottom 530 of the panel 160, a person manually adjusting the mechanism only has to pull or push on the actuator rod 500, instead of having to rotate a small knob or disc located on the side of the panel 160, as done in the prior art. Also included on the grasping end 505 of the actuator rod 500 are markings 535 to indicate the amount of adjustment made by a person adjusting the mechanism, and a knob 536 is shown covering a threaded end 538 of the actuator rod 500. The markings 535 have a direct relationship to the vertical downtilt angle of the beam. For example, a zero marking on the rod correlates to a zero degree downtilt angle. Since the markings 535 are not detented, a user may adjust the downtilt angle as much or as little as needed. The downtilt angle need not be moved in degree or half degree increments. The knob 536 screws onto the threaded end 538 and enables the user to easily grasp the actuator rod 500 for movement purposes.

Figure 6A:
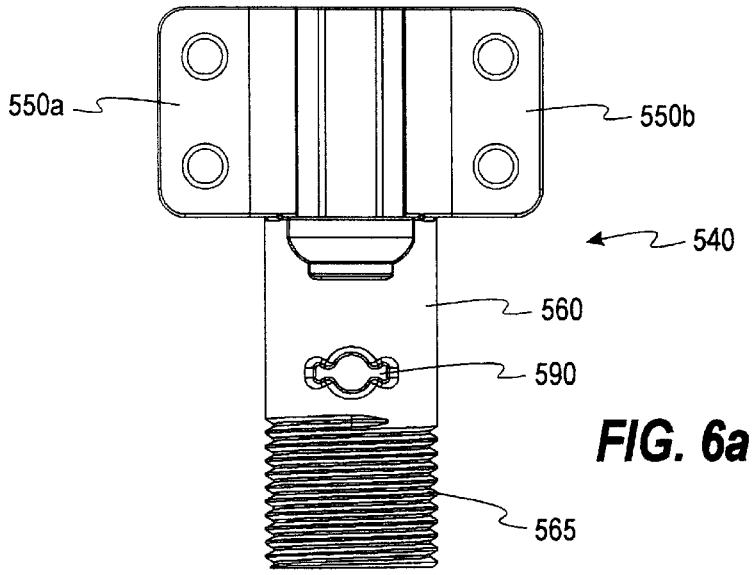
FIG. 6*a* is a front view of a bushing mount according to one embodiment of the present invention.
Figure 6B:
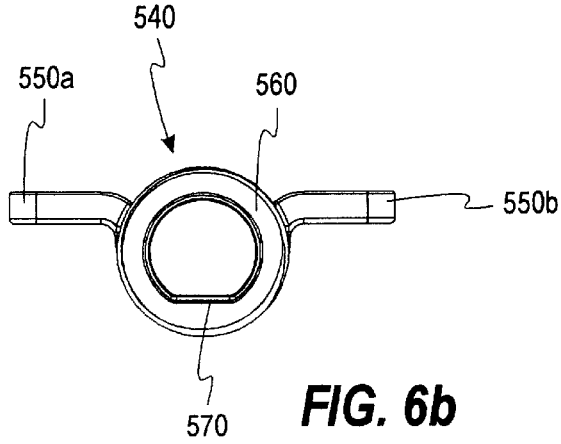
FIG. 6*b* is an end view of a bushing mount according to one embodiment of the present invention.
Figure 6C:
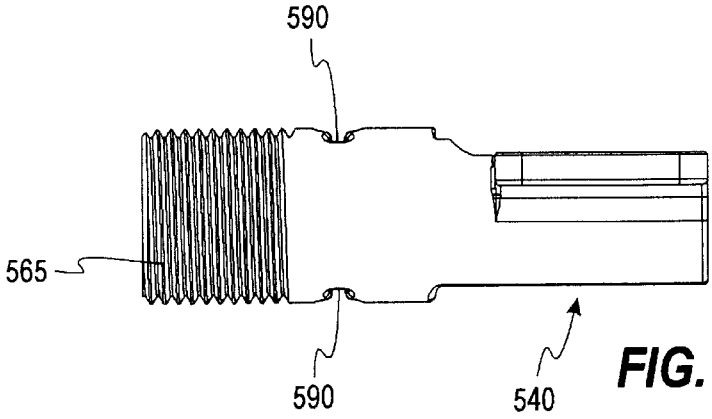
FIG. 6*c* is a side view of a bushing mount according to one embodiment of the present invention.

The actuator rod 500 is mounted onto the bottom 530 of the panel 160 by a bushing mount 540. The bushing mount 540 is best illustrated in FIGS. 6*a*–6*c*. The bushing mount 540 comprises a pair of brackets 550*a*, 550*b* which are attached to the panel 160. In the embodiment shown, the brackets 550*a*, 550*b* are attached via a pair of screws 560*a*, 560*b* (shown in FIG. 5). It is also contemplated, however, that other methods, such as rivets, adhesive heat staking, welding, and brazing, may be utilized.

The bushing mount 540 also has a cylindrical portion 560 adapted to receive the actuator rod 500. The cylindrical portion 560 of the bushing mount 540 allows the actuator rod 500 to be slid up and down, enabling movement. To prevent the actuator rod 500 from rotating within the cylindrical portion 560, however, a flat section 570 (FIG. 6*b*) is included on the inner wall of the cylindrical portion 560. One end of the cylindrical portion 560 includes a threaded portion 565 which will be described in more detail below.

As mentioned above, the grasping end 505 of the actuator rod 500 includes markings 535. The bushing mount 540 includes an indicator window 590 on opposite sides of the cylindrical portion 560 to enable a user to see the markings 535 (seen in FIG. 6*c*). Also, in one embodiment, the bushing mount 540 may be clear plastic so that all of the markings 535 are visible to the user.

Figure 7:
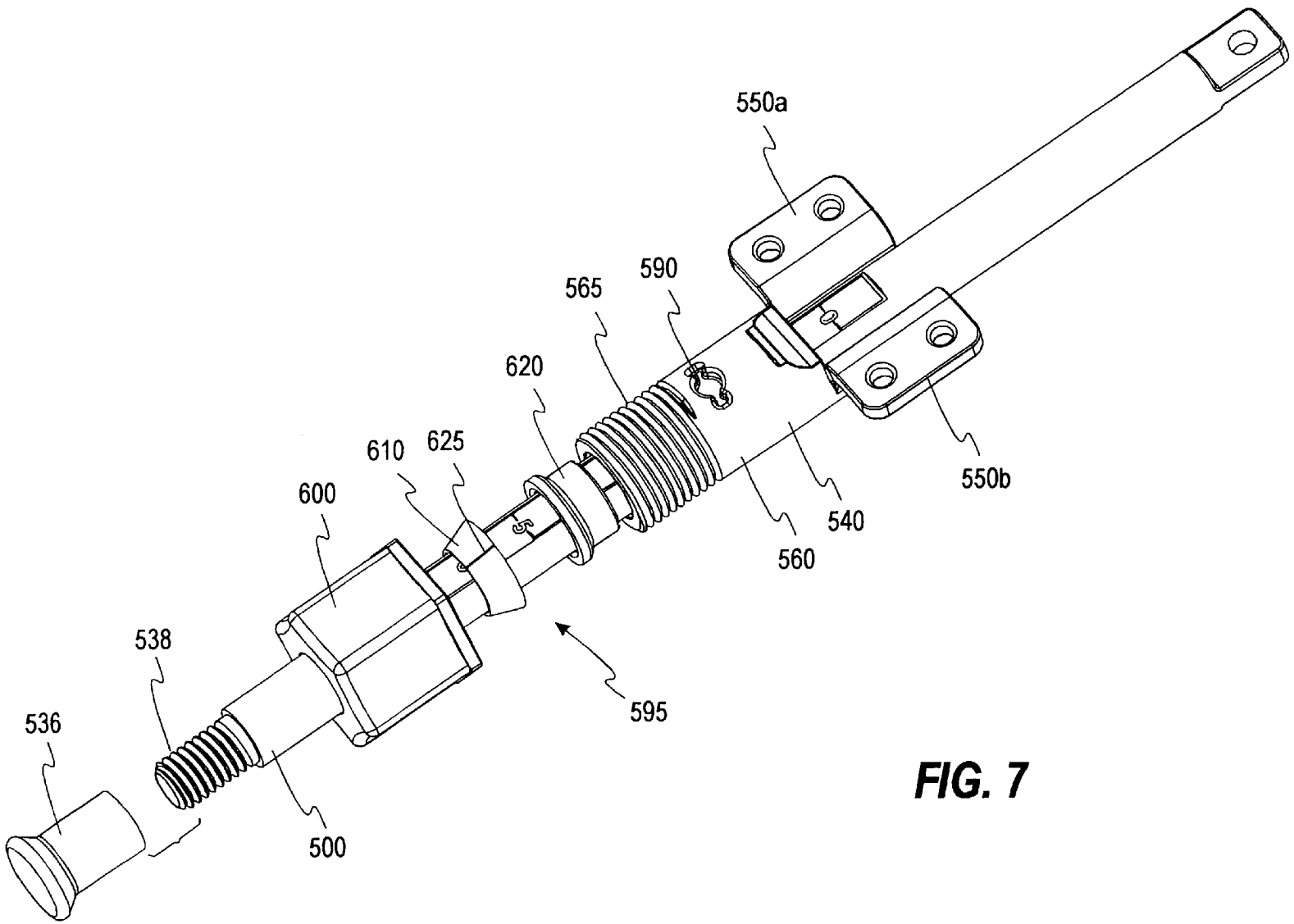
FIG. 7 is an exploded perspective view of an actuator rod according to one embodiment of the present invention.
Figure 8:
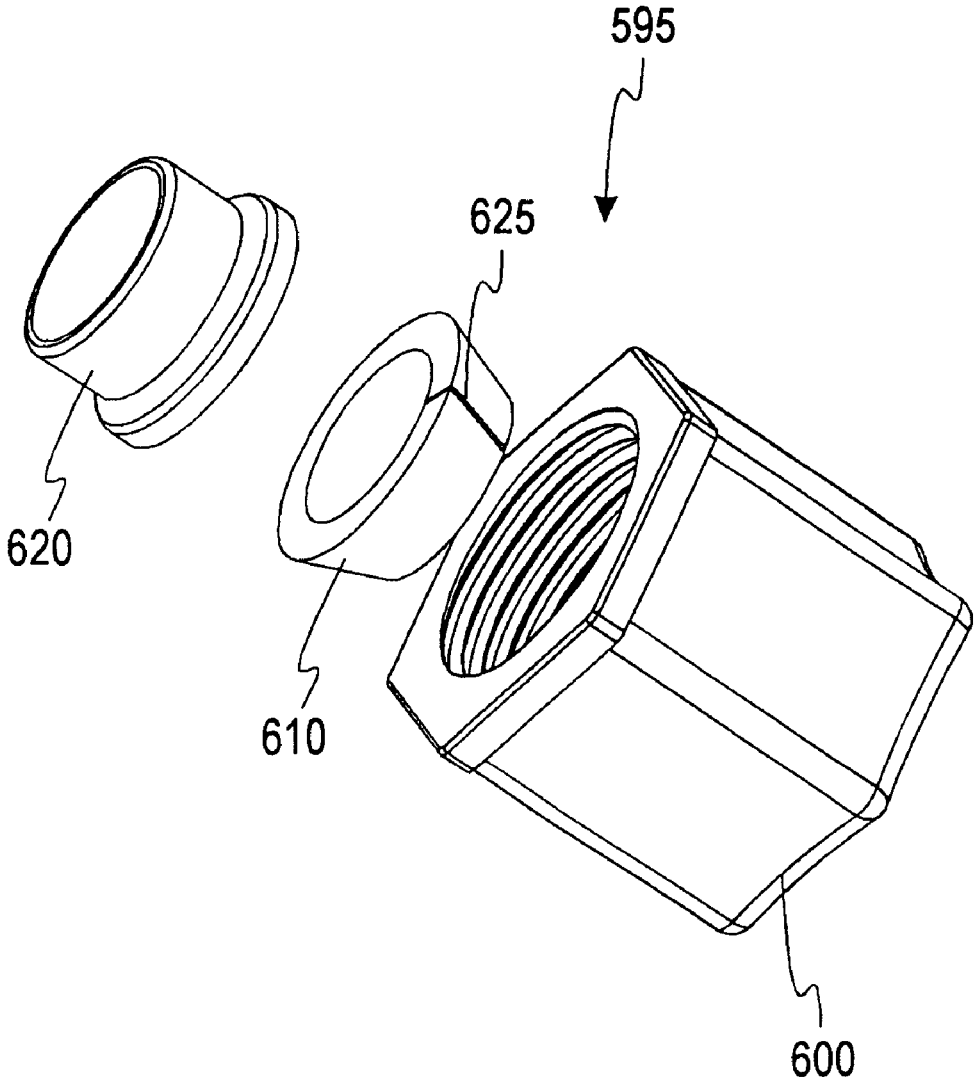
FIG. 8 is a perspective view of a compression nut according to one embodiment of the present invention.

As shown in FIGS. 7 and 8, a compression nut 595 is also slid over the actuator rod 500. The compression nut 595 includes three parts, a threaded nut 600, a plastic gripper 610, and a ferrule 620. The threaded nut 600 of the compression nut 595 screws over the threaded portion 565 of the bushing mount 540 and acts to lock the actuator rod 500 in place. When the threaded nut 600 is being screwed over the threaded portion 565 of the bushing mount 540, the plastic gripper 610 and the ferrule 620 are sandwiched against the bushing mount 540. The ferrule acts as a seal against the bushing mount 540. The plastic gripper 610 contains a slit 625, which decreases in width as the threaded nut 600 is tightened against the bushing mount 540. This causes the compression nut 595 to grip the bushing mount 540, and lock the actuator rod 500 in place.

Figure 8A:
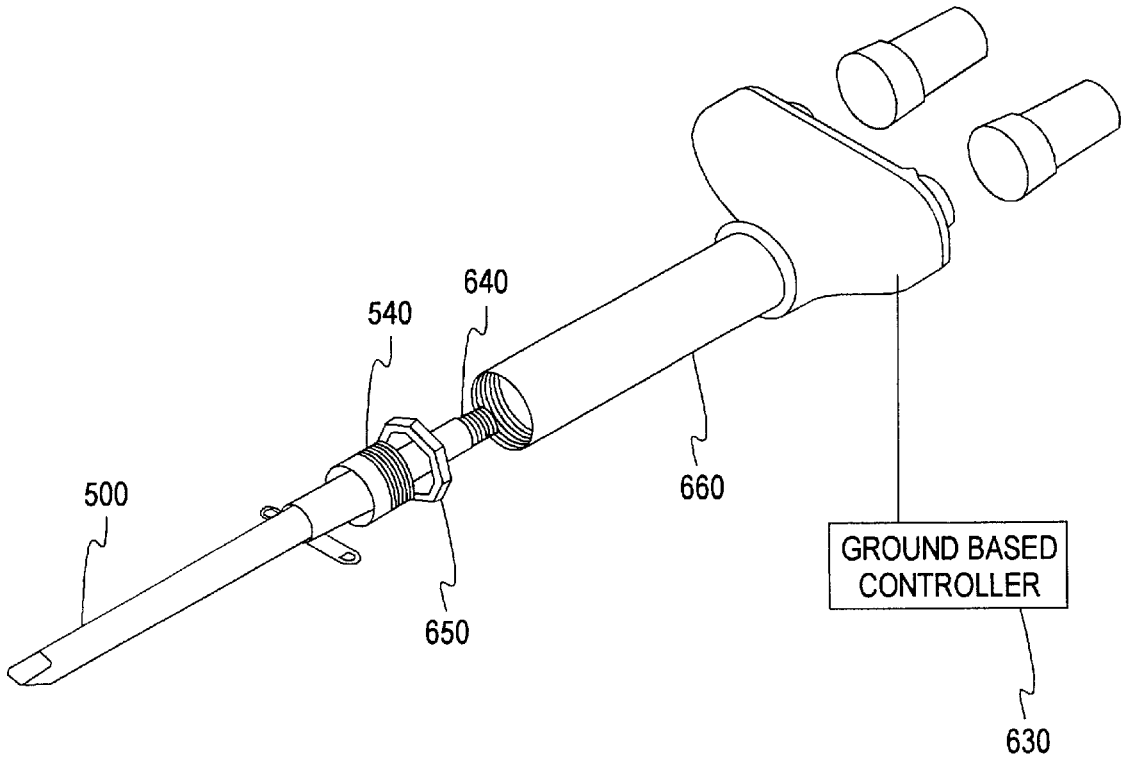
FIG. 8A is a perspective view of an actuator rod and an electrical actuator having a ground-based controller according to one embodiment of the present invention.
Figure 9:
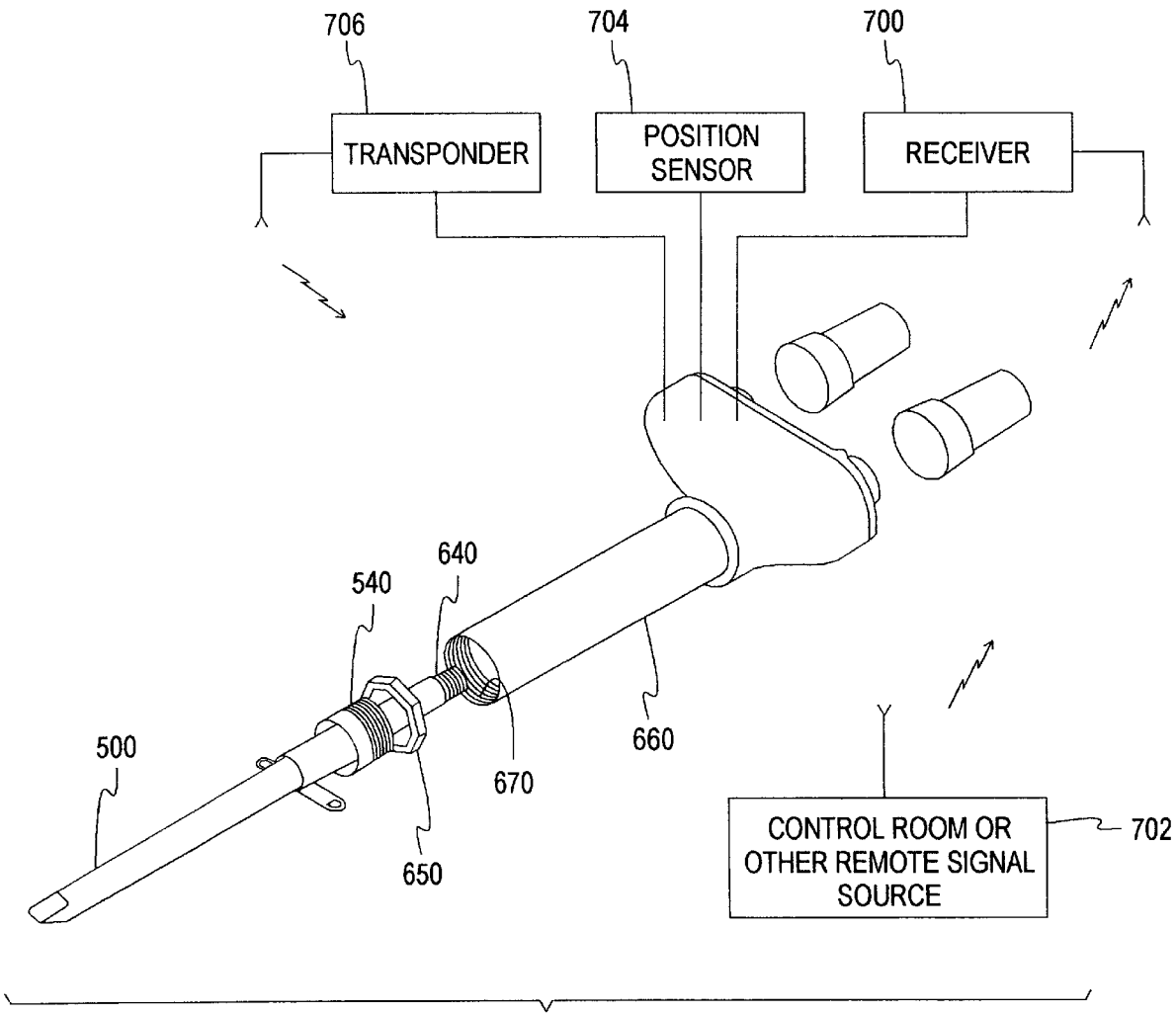
FIG. 9 is a perspective view of an actuator rod and an electrical actuator according to one embodiment of the present invention.

Although it is useful to have a manual actuator, it may be more desirable to have an electrical actuator that may be controlled from the ground or even remotely, for example, from a control room 630 (FIG. 8A). In FIG. 9, converting the manual actuator described above into an electrical actuator 660 is illustrated. The electrical actuator 660 comprises a piston (not shown) and a threaded barrel 670. To convert the manual actuator, the compression nut 595 and the knob 536 must first be removed. Then, a lock nut 650 is threaded onto the bushing mount 540. The threaded end 538 of the actuator rod 500 is threaded into the piston. The barrel 670 of the electrical actuator 660 is then pushed up towards the threaded portion 565 of the bushing mount 540 and threaded. Once both the piston and the threaded barrel are completely threaded onto the actuator rod 500, the lock nut 650 is tightened, locking the bushing mount 540 to the threaded barrel 670.

The electrical actuator 660 may be a step motor in a fixed position relative to the panel 160. The step motor rotates, driving a screw or shaft in a linear motion. The screw or shaft is coupled to the actuator rod 500 and, thus, moves the actuator rod 500 up and down, depending on the rotation of the step motor. It is also contemplated that the electrical actuator 660 may include a receiver 700 adapted to receive adjustment signals from a remote source 702. A sensor 704 adapted to sense the position of the actuator rod 500 may also be included. A transponder 706 may also be included to return a signal to the remote location or to a signal box which indicates the amount of adjustment made.

The present invention may, thus, be easily converted from a manual actuator to an electrical actuator depending on the needs and wishes of the user. The actuator, thus provides flexibility in use, allowing a user to purchase a manual actuator and then upgrade to an electrical actuator at a later date. The advantages to this are many. The user may not initially wish to expend the money to pay for an electrical actuator if there is rarely a need to adjust the vertical beam. As that need changes, however, the user may purchase the electrical actuator and easily convert the actuator.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A cellular base station antenna system configured to produce a beam of fixed elevation, comprising:

an elongated panel antenna system adapted to mount a plurality of spaced radiators;

a printed circuit board having conductive traces including a transmission line interconnecting at least selected ones of said radiators; and an electromechanical phase adjustment system including a phase adjuster connected to a signal feed coupled to said transmission line, said phase adjuster having at least one component intermittently moveable by an electrical actuator responsive to commands from a remote signal source to adjust the relative signal phasing of said interconnected radiators between different phase values, and thereby adjust the fixed elevation of the beam, said electrical actuator being positioned at an edge of said panel antenna and coupled to said moveable component of the phase shifter by a mechanical actuator extending lengthwise of said panel antenna, said electrical actuator having a receiver and transponder for communicating wirelessly with said remote source.

2. The antenna system defined by claim 1 wherein said moveable component is an arcuately moveable wiper capacitively coupled to said transmission line, said wiper comprising a conductive trace on an insulated substrate.

3. The antenna system defined by claim 1 including a sensor for sensing the position of said phase adjuster.

4. The antenna system defined by claim 3 wherein said remote signal source is responsive to said sensor.

5. The antenna system defined by claim 3 wherein said sensor senses a position of said mechanical actuator.

6. The antenna system defined by claim 5 wherein said remote signal source is responsive to said sensor.

7. A cellular base station antenna system comprising:

an elongated panel adapted to be installed vertically and to mount a plurality of longitudinally spaced radiators;

a signal feed network operatively coupled to said radiators;

a signal phase adjuster in said feed network; and a linearly reciprocable, phase-adjustment mechanical actuator coupled to said phase adjuster and having a terminus located near a lower edge of said panel.

8. The system defined by claim 7 wherein said signal phase adjuster includes a pivotally mounted, phase-adjusting wiper capacitively coupled in said feed network.

9. The system defined by claim 8 wherein said mechanical actuator is coupled to said wiper and is configured to convert linear motion of said mechanical actuator to arcuate motion of said wiper.

10. The system defined by claim 8 further including a first printed circuit board which includes at least a portion of said feed network, and wherein said wiper is pivotally mounted on said first printed circuit board.

11. The system defined by claim 10 wherein said wiper comprises a second printed circuit board metallized on one side.

12. The system defined by claim 7 wherein said mechanical actuator terminus extends below a lower edge of said panel.

13. The system defined by claim 7 wherein said mechanical actuator is adapted for conversion between manual manipulation and manipulation by an electrical actuator.

14. The system defined by claim 7 further including a first printed circuit board which includes at least a portion of said feed network.

15. The system defined by claim 14 further including a power divider on said first printed circuit board.

16. The system defined by claim 7 wherein said antenna system includes first and second phase adjusters coupled to and manipulated by said mechanical actuator.

17. The system defined by claim 16 wherein said first and second phase adjusters are mechanically coupled.

18. The system defined by claim 17 wherein said second phase shifter is rotatably linked to said first phase adjuster.

19. The system defined by claim 16 wherein adjustment of said first phase adjuster simultaneously adjusts said second phase adjuster.

20. The system defined by claim 7 wherein said mechanical actuator has indicia providing an indication of a beam downtilt angle.

21. The system defined by claim 7 wherein said mechanical actuator includes a position lock.

22. The system defined by claim 7 wherein said phase adjuster further includes a fixed printed circuit board;

a signal input mounted on said fixed printed circuit board;

a wiper electromagnetically coupled to said signal input; and a transmission line electromagnetically coupled to said wiper and formed of a portion of said signal feed network, wherein a movement of said wiper changes an effective length of said transmission line.

23. The system defined by claim 22 wherein said wiper is pivotally coupled to said signal input.

24. The system defined by claim 22 wherein said wiper is a rotatable printed circuit board.

25. The system defined by claim 24 wherein a portion of said transmission line is arcuate in shape.

26. The system defined by claim 25 wherein said wiper further includes an arcuate section having a radius of curvature substantially equal to a radius of curvature of said transmission line, such that as said wiper is pivoted over said transmission line, said wiper remains substantially in alignment with said transmission line.

27. The system defined by claim 7 wherein said mechanical actuator is coupled to and mechanically adjusted by an electrical actuator responsive to commands from a remote signal source.

28. The system defined by claim 27 wherein said electrical actuator includes a receiver and a transponder for communicating wirelessly with said remote signal source.

29. The system defined by claim 28 wherein said electrical actuator includes a sensor for sensing the position of said mechanical actuator and thereby beam elevation.

30. A cellular base station antenna system comprising:

a panel antenna adapted to mount a plurality of radiators;

a signal feed network operatively coupled to said radiators;

at least one mechanical phase adjuster located on said panel and forming a portion of said signal feed network, said phase adjuster having relatively displaceable phase-adjusting components; and an electrical actuator supported by and positioned off said panel antenna, said electrical actuator being mechanically coupled to at least one of said phase adjusting components.

31. The antenna system defined by claim 30 wherein said electrical actuator is coupled to at least one of said phase adjusting components by a mechanical actuator.

32. The antenna system defined by claim 31 wherein linear motion of said mechanical actuator causes rotational movement of said phase adjusting component.

33. The antenna system defined by claim 31 wherein said mechanical actuator is adapted for conversion to manual manipulation.

34. The antenna system defined by claim 31 including a sensor for sensing a position of said mechanical actuator.

35. The antenna system defined by claim 34 wherein said electrical actuator is controlled by a remotely located signal source which is responsive to said sensor.

36. The antenna system defined by claim 30 wherein said panel antenna is oriented vertically, and wherein said electrical actuator is located below said panel.

37. The antenna system defined by claim 30 wherein said electrical actuator is controlled by a remotely located signal source.

38. The antenna system defined by claim 37 wherein said electrical actuator is configured to be controlled wirelessly.

39. The antenna system defined by claim 30 wherein said panel antenna includes a first printed circuit board which includes at least a portion of said signal feed network.

40. The antenna system defined by claim 39 further including a rotatable wiper mounted on said first printed circuit board, said wiper defining a relatively displaceable phase adjusting component.

41. The antenna system defined by claim 40 wherein said wiper includes a second printed circuit board metallized on one side.

42. The antenna system defined by claim 30 wherein said panel antenna includes a plurality of phase adjusters coupled to and manipulated by a common mechanical actuator.

43. The antenna system defied by claim 30 wherein said electrical actuator includes an electrical motor.

44. A cellular base station antenna system producing a beam of fixed elevation, comprising:

a panel antenna adapted to mount a plurality of radiators;

a transmission line interconnecting said radiators; and a phase adjustment system for varying a relative phasing of said interconnected radiators, said phase adjustment system further including a printed circuit board having a printed conductor forming a portion of said transmission line; and a phase adjuster connected to a signal feed and coupled to said printed conductor, said phase adjuster having an intermittently moveable component configured to adjust a relative signal phasing of said interconnected radiators between different phase values, and thereby to adjust the fixed beam elevation, said phase adjuster system being mechanically manipulated by an electrical actuator responsive to commands from a remote signal source.

45. The antenna system defined by claim 44 further including a moveable printed circuit board pivotally connected to said printed circuit board and having a conductive layer capacitively coupled to said printed conductor.

46. The antenna system defined by claim 44 further including a power divider printed on said printed circuit board between said signal feed and said phase adjuster.

47. The antenna system assembly defined by 44 further including a mechanical actuator connected between said phase adjuster and said electrical actuator.

48. An antenna system producing a beam having an adjustable elevation, comprising:

a panel antenna adapted to mount a plurality of radiators;

a signal feed operatively coupled to said radiators;

at least one mechanical phase adjuster located on said panel antenna, said phase adjuster having relatively displaceable phase-adjusting components;

an electrical actuator positioned near the edge of said panel, said electrical actuator being mechanically coupled to said phase adjuster by a mechanical actuator; and said system providing indicia indicating by the physical position of the actuator, the elevation of the beam.

49. A cellular base station antenna system comprising:

a panel antenna adapted to mount a plurality of radiators;

printed circuit board means;

a network of transmission lines connecting a signal feed to each of said radiators, each of said transmission lines including a printed conductor trace on said printed circuit board means, said traces having differing trace lengths to alter a default phasing of said radiators; and a power divider printed on said printed circuit board means between said feed and said network.

50. The antenna system defined by claim 49 wherein said network of transmission lines includes a plurality of coaxial cables of equal length.

51. A cellular base station antenna system adapted both for manual adjustment of fixed beam elevation and for retrofitting of an electrical actuator for electrical adjustment of beam elevation, comprising:

a panel antenna adapted to mount a plurality of spaced radiators;

a signal feed network operatively coupled to said radiators;

a signal phase adjuster in said feed network; and a phase-adjustment mechanical actuator coupled to said phase adjuster, said mechanical actuator being configured first for manual adjustment of beam elevation and second for selective attachment of an electrical actuator for remote electrical adjustment of beam elevation.

52. The system defined by claim 51 wherein said mechanical actuator has a terminus below an edge of said panel antenna, said terminus being configured for manual adjustment of beam elevation, and for attachment of said electrical actuator.

53. The system defined by claim 52 wherein said terminus includes a threaded nut with an opening which passes an elongated member extending to said phase shifter and driven by said electrical actuator.

54. The system defined by claim 53 wherein said elongated member contains indicia which indicates beam elevation based upon the position of the elongated member.

55. The system defined by claim 51 including a plurality of spaced phase shifters, and wherein said mechanical actuator includes an elongated member which extends lengthwise along said panel antenna and is coupled to said phase shifters for simultaneous manual or electrical manipulation of each of them.

* * * * *

US006573875C1

(12) INTER PARTES REEXAMINATION CERTIFICATE (0182nd)

United States Patent

Zimmerman et al.

(10) Number: US 6,573,875 C1

(45) Certificate Issued: *Aug. 17, 2010

(54) ANTENNA SYSTEM

(75) Inventors: Martin L. Zimmerman, Chicago, IL (US); Jamie Paske, Darien, IL (US); Jim Giacobazzi, Bloomingdale, IL (US); Kevin E. Linehan, Justice, IL (US)

(73) Assignee: Andrew Corporation, Orland Park, IL (US)

Reexamination Request:
No. 95/000,063, Dec. 3, 2004

Reexamination Certificate for:

| | |
|---|---|
| Patent No.: | **6,573,875** |
| Issued: | **Jun. 3, 2003** |
| Appl. No.: | **09/788,790** |
| Filed: | **Feb. 19, 2001** |

( * ) Notice: This patent is subject to a terminal disclaimer.

(51) Int. Cl.

| | |
|---|---|
| ***H01Q 1/24*** | (2006.01) |
| ***H01Q 3/30*** | (2006.01) |
| ***H01Q 3/32*** | (2006.01) |
| ***H01Q 21/08*** | (2006.01) |

(52) U.S. Cl. ..... 343/853; 343/757

(58) Field of Classification Search ..... None
See application file for complete search history.

(56) References Cited

U.S. PATENT DOCUMENTS

| | | | |
|---|---|---|---|
| 5,512,914 A | 4/1996 | Hadzoglou | |
| 5,917,455 A | 6/1999 | Huynh | |
| 6,198,458 B1 | 3/2001 | Heinz | |
| 6,208,222 B1 | 3/2001 | Sinsky | |
| 6,310,585 B1 | 10/2001 | Marino | |
| 6,366,237 B1 | 4/2002 | Charles | |
| 6,538,619 B2 * | 3/2003 | Heinz et al. | 343/853 |

FOREIGN PATENT DOCUMENTS

| | | |
|---|---|---|
| AU | 1993-41625/664625 | 11/1995 |
| EP | 0618639 B1 | 9/1999 |
| JP | 05-121915 | 5/1993 |

OTHER PUBLICATIONS

Motorola, "The Specification of Phase Shifter Unit for Tilting Antenna" Ver. 3, 7 pages, Sep. 28, 1998 (Specification for a motorized VED).

Hitachi Cable Ltd., cdmaOne MH12–XA60–08U212B, MH12–XA120–08U212B, 182 pages, 1998 (Written Proposal for the VED antenna).

DKK, Technical Proposal (Nihon Dengyo Kosaku) 113 pages, Sep. 1998 (Written Proposal for the VED antenna).

Deltec NZ Limited Cover Sheet: 1994, (2 pages).

Product Specification sheet entitled "Antenna Selection Guide, 800–1000 MHz", V 2.5, May 1998 (1 page).

Product Specification sheet entitled "Deltec Mobile Telephone Panel Antenna (MTPA) 168 Compact—Teletilt—Varitilt" DPC–A26 May 1998 (2 pages).

Product Specification sheet entitled "Deltec Specifications for Mobile Telephone Panel Antenna, 45° panel antenna for 820–890MHz", DPC–A9 Feb. 1998 (1 page).

(Continued)

*Primary Examiner*—Pia Tibbits

(57) ABSTRACT

An antenna assembly for emitting a signal. The antenna assembly includes at least two antennas which are separated into a first group and a second group. Both groups of antennas are mounted on a panel. A first phase adjuster is coupled to the first antenna group. The first phase adjuster is also coupled to a second phase adjuster, which is also coupled to said second antenna group. The first phase adjuster is coupled to the second phase adjuster, such that an adjustment of the first phase adjuster causes an adjustment of the second phase adjuster. The first phase adjuster is adapted to adjust a phase angle of the signal of the first antenna group, while the second phase adjuster is adapted to adjust a phase angle of the signal of said second antenna group.

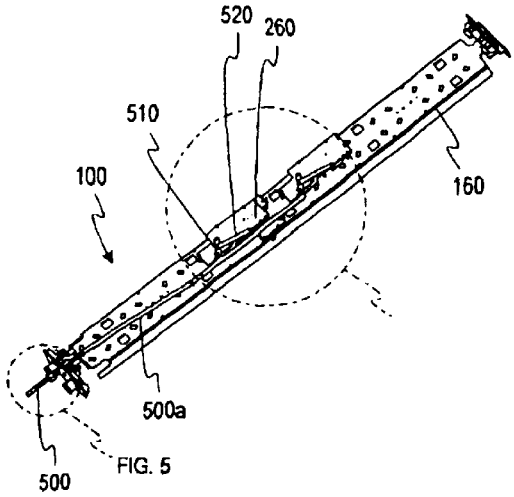

FIG. 5

OTHER PUBLICATIONS

Product Specification sheet entitled "Deltec Mobile Telephone Panel Antenna (MTPA), Dual Polarisation 888 Compact—Teletilt—Varitilt" DPC–A17 Jul. 1998 (2 pages).

Product Specification sheet entitled"Deltec Specifications for Mobile Telephone Panel Antenna, 90° Beamwidth 168 Compact Single Polarisation", DPC–A20 May 1998 (2 pages).

Product Specification sheet entitled"Deltec Mobile Telephone Panel Antenna (MTPA), 168 Compact—Teletilt—Varitilt", DPC–A19 May 1998 (1 page).

Product Specification sheet entitled"Teletilt Control Unit and Hand–held Controller", DPC–TT1 Jul. 1998 (2 pages).

Deltec Mobile Telephone Panel Array (MTPA) Antenna, Sep. 1994 (3 pages).

Varitilt Continuously Variable Electrical Downtilt Models, May 1994 (1 page).

* cited by examiner

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 4, lines 4-24:

In this particular embodiment, the conductive wiper 220 is a first rotatable PC board 250 with a metallic side. The first transmission line 240 is mounted on a separate fixed PC board 260. *The transmission lines on the fixed PC board 260 may comprise printed conductors or traces.* The fixed PC board 260 and first rotatable PC board 250 act as a dielectric between the capacitor. In prior art systems, an air dielectric was sometimes used. If the conductive wiper changes its spacing relative to the first arcuate portion 230, however, the capacitor's capacitance is altered, thus, changing the impedance match of the phase shifter. If the two sections touch, the capacitance is destroyed, which adversely affects the performance of the antenna even more. Other systems use a sheet dielectric to separate the conductive wiper from the transmission line which have to be mounted using standoffs and point fasteners. The sheet, however, tends to attenuate the capacitive effect. By using the PC boards as the dielectric, the conductive wiper cannot touch the transmission line nor are the capacitive effects attenuated. Also, the manufacturing costs for making the PC board are much lower than having to mount the sheet dielectric.

AS A RESULT OF REEXAMINATION, IT HAS BEEN DETERMINED THAT:

The patentability of claims 30-43, 51 and 55 is confirmed.

Claims 45 and 50 are cancelled.

Claims 1, 7, 18, 44, 48, 49 and 52 are determined to be patentable as amended.

Claims 2-6, 8-17, 19-29, 46-47, 53 and 54, dependent on an amended claim, are determined to be patentable.

1. A cellular base station antenna system configured to produce a beam of fixed elevation, comprising:

an elongated panel antenna system adapted to mount a plurality of spaced radiators;

a printed circuit board having conductive traces including a transmission line interconnecting at least selected ones of said radiators; and an electromechanical phase adjustment system including a phase adjuster connected to a signal feed coupled to said transmission line, said phase adjuster having at least one component intermittently moveable by an electrical actuator responsive to commands from a remote signal source to adjust the relative signal phasing of said interconnected radiators between different phase values, and thereby adjust the fixed elevation of the beam, said electrical actuator being positioned at [an edge] *a bottom* of said panel antenna and coupled to said moveable component of the phase [shifter] *adjuster* by a mechanical actuator extending lengthwise of said panel antenna, said electrical actuator having a receiver and transponder for communicating wirelessly with said remote source.

7. A cellular base station antenna system comprising:

an elongated panel adapted to be installed vertically and to mount a plurality of longitudinally spaced radiators;

a signal feed network operatively coupled to said radiators;

a signal phase adjuster in said feed network; and a linearly reciprocable, phase-adjustment mechanical actuator coupled to said phase adjuster and having a terminus located near a [lower edge] *bottom* of said panel.

18. The system defined by claim 17 wherein said second phase [shifter] *adjuster* is rotatably linked to said first phase adjuster.

44. A cellular base station antenna system producing a beam of fixed elevation, comprising:

a panel antenna adapted to mount a plurality of radiators;

a transmission line interconnecting said radiators; and a phase adjustment system for varying a relative phasing of said interconnected radiators, said phase adjustment system further including a printed circuit board having a printed conductor *pattern* forming a portion of said transmission line; [and]

*a moveable printed circuit board pivotally connected to said printed circuit board and having a conductive layer capacitively coupled to said printed conductor pattern;* and a phase adjuster connected to a signal feed and coupled to said printed conductor *pattern*, said phase adjuster having an intermittently moveable component configured to adjust a relative signal phasing of said interconnected radiators between different phase values, and thereby to adjust the fixed beam elevation, said phase adjuster system being mechanically manipulated by an electrical actuator responsive to commands from a remote signal source*, said printed conductor pattern including transmission line sections of varying lengths between the phase adjustor and the radiators.*

48. An antenna system producing a beam having an adjustable elevation, comprising:

a panel antenna adapted to mount a plurality of radiators;

a signal feed operatively coupled to said radiators;

at least one mechanical phase adjuster located on said panel antenna, said phase adjuster having relatively displaceable phase-adjusting components;

an electrical actuator positioned near [the edge] *a bottom* of said panel, said electrical actuator being mechanically coupled to said phase adjuster by a mechanical actuator; and said system providing indicia indicating by the physical position of the actuator, the elevation of the beam.

49. A cellular base station antenna system comprising:

a panel antenna adapted to mount a plurality of radiators;

printed circuit board means;

a network of transmission lines connecting a signal feed to each of said radiators, each of said transmission lines including a printed conductor trace on said printed circuit board means, said traces having differing trace lengths to alter a default phasing of said radiators, *said network of transmission lines further including a plurality of coaxial cables of equal length*; and a power divider printed on said printed circuit board means between said *signal* feed and said network.

52. The system defined by claim 51 wherein said mechanical actuator has a terminus below [an edge] *a bottom* of said panel antenna, said terminus being configured for manual adjustment of beam elevation, and for attachment of said electrical actuator.

* * * * *